US010639907B2

(12) United States Patent
Imaizumi

(10) Patent No.: US 10,639,907 B2
(45) Date of Patent: May 5, 2020

(54) PRINTING APPARATUS AND THERMAL HEAD

(71) Applicant: SEIKO EPSON CORPORATION, Tokyo (JP)

(72) Inventor: Atsuyuki Imaizumi, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/039,870

(22) Filed: Jul. 19, 2018

(65) Prior Publication Data

US 2019/0023025 A1 Jan. 24, 2019

(30) Foreign Application Priority Data

Jul. 20, 2017 (JP) ..... 2017-140630
Feb. 28, 2018 (JP) ..... 2018-034409

(51) Int. Cl.
*B41J 2/355* (2006.01)
*B41J 2/32* (2006.01)

(52) U.S. Cl.
CPC ..... *B41J 2/355* (2013.01); *B41J 2/32* (2013.01)

(58) Field of Classification Search
CPC ..... B41J 2/355
See application file for complete search history.

(56) References Cited

U.S. PATENT DOCUMENTS 4,930,915 A * 6/1990 Kikuchi ..... B41J 2/505 347/211
5,363,134 A * 11/1994 Barbehenn ..... B41J 2/04506 347/19
5,940,095 A * 8/1999 Parish ..... B41J 2/04541 347/19
6,871,933 B2 * 3/2005 Li ..... B41J 2/17546 347/19
7,309,120 B2 * 12/2007 Hatsui ..... B41J 2/14072 347/12

(Continued)

FOREIGN PATENT DOCUMENTS

EP 0916503 * 5/1999 ..... B41J 2/04541
EP 1306221 * 5/2003 ..... B41J 2/175

(Continued)

OTHER PUBLICATIONS

Google translation of JP 2003054019, published on Feb. 2003 (Year: 2003).*

*Primary Examiner* — Huan H Tran
(74) *Attorney, Agent, or Firm* — Foley & Lardner LLP

(57) ABSTRACT

A thermal printer has an identification information holding circuit that has identification information, a line thermal head in which the identification information holding circuit is mounted, a control signal line through which a signal that controls the line thermal head is transmitted, a memory that stores specification information about the line thermal head corresponding to the identification information, and a controller that acquires the identification information that has been output from the identification information holding circuit through the control signal line and also acquires the specification information about the line thermal head from the memory according to the acquired identification information.

8 Claims, 4 Drawing Sheets

(56) References Cited

U.S. PATENT DOCUMENTS

| | | | | |
|---|---|---|---|---|
| 7,649,542 | B2 * | 1/2010 | Lee | B41J 2/17543 347/171 |
| 8,049,770 | B2 * | 11/2011 | Matsuda | B41J 19/202 347/171 |
| 8,109,610 | B2 * | 2/2012 | Toge | B41J 2/14072 347/50 |
| 8,284,225 | B2 * | 10/2012 | Imaizumi | B41J 2/35 347/211 |
| 2010/0182390 | A1 | 7/2010 | Imaizumi | |

FOREIGN PATENT DOCUMENTS

| | | | | |
|---|---|---|---|---|
| JP | 2003054019 | * | 2/2003 | B41J 2/32 |
| JP | 2003-334985 | * | 11/2003 | B41J 2/35 |
| JP | 2010-162810 A | | 7/2010 | |

* cited by examiner

FIG. 4

111

| F1 | F2 | F3 | |
|---|---|---|---|
| IDENTIFICATION INFORMATION | ENTITY | RESISTANCE | |
| 00 | COMPANY A | 500 OHMS | R1 |
| 01 | COMPANY A | 800 OHMS | R2 |
| 10 | COMPANY B | 500 OHMS | R3 |
| 11 | COMPANY B | 800 OHMS | R4 |

PRINTING APPARATUS AND THERMAL HEAD

CROSS REFERENCES TO RELATED APPLICATIONS

The present invention contains subject matter related to Japanese Patent Application Nos. 2017-140630 and 2018-34409 filed in the Japanese Patent Office on Jul. 20, 2017 and Feb. 28, 2018, respectively, the entire contents of which are incorporated herein by reference.

BACKGROUND

1. Technical Field

The present invention relates to a printing apparatus and a thermal head.

2. Related Art

A conventional technology that acquires information from a thermal head is known (see JP-A-2010-162810, for example). JP-A-2010-162810 discloses a printing apparatus that acquires the number of heat-generating elements in a thermal head by entering, into a shift register, data in which a value corresponding to a first one clock is taken as 1 and each subsequent value is taken as 0 and counting the number of clocks until data output from the shift register becomes 1.

SUMMARY

In JP-A-2010-162810, however, only the number of heat generating elements in the thermal head is considered, so other information about the thermal head cannot be acquired. In the acquisition of information about a thermal head, besides signal lines used to control the thermal head, addition of a new special signal line used to acquire the information may not be desired in consideration of costs and other factors.

An advantage of some aspects of the invention is to acquire information about a thermal head from the thermal head without having to add a new signal line.

A printing apparatus according to a first aspect of the invention includes a logical circuit that has identification information, a thermal head in which the logical circuit is mounted, a signal line through which a signal that controls the thermal head is transmitted, a memory that stores information about the thermal head corresponding to the identification information, and a control circuit that acquires the identification information that has been output from the logical circuit through the signal line and also acquires the information about the thermal head from the memory according to the acquired identification information.

A printing apparatus according to a second aspect of the invention includes a thermal head in which a logical circuit that has identification information is mounted, a plurality of signal lines through which signals that control the driving of the thermal head are conveyed, a memory that stores specification information about the thermal head in relation to the identification information, and a processor that acquires the identification information through one of the plurality of signal lines, the identification information having been output from the logical circuit, and also acquires the specification information related to the acquired identification information from the memory. Of the plurality of signal lines, the signal line through which the identification information is conveyed is a signal line through which print data is conveyed to the thermal head.

With this structure, identification information that has been output from the logical circuit mounted in the thermal head is acquired through a signal line through which a signal that controls the thermal head is transmitted and information about the thermal head is acquired from the memory. In the acquisition of identification information, therefore, it is possible to acquire information about the thermal head from the thermal head without having to add a new special signal line.

In the printing apparatus described above, the signal line is one of a plurality of signal lines that include a first signal line through which print data is transmitted to the thermal head. The control circuit is connected to the first signal line. The control circuit has a port that is switchable between an input setting and an output setting. The control circuit switches the port to the input setting to acquire the identification information that has been output from the logical circuit to the first signal line.

With this structure, identification information can be acquired by switching a port to the input setting, the port being switched to the output setting when the thermal head is controlled. Therefore, it is possible to acquire identification information about the thermal head without having to newly add a special port, a signal line, or the like.

In the printing apparatus described above, the signal line is one of a plurality of signal lines that include a second signal line through which a latch signal is transmitted to the thermal head, the latch signal causing print data to be temporarily held. When the latch signal is not in an active state in the control of the thermal head, the logical circuit outputs the identification information to the control circuit.

With this structure, when the latch signal is not in an active state in the control of the thermal head, the logical circuit outputs the identification information to the control circuit. Therefore, it is possible to acquire the identification information about the thermal head without interference with the control of the thermal head.

In the printing apparatus described above, the signal line is one of a plurality of signal lines that include a third signal line through which a clock signal that synchronously transmits print data to the thermal head is transmitted. The logical circuit outputs the identification information in synchronization with the clock signal entered through the third signal line.

With this structure, since the logical circuit outputs identification information in synchronization with a clock signal entered through the third signal line, it is possible to acquire identification information about the thermal head without having to add a new special signal line used to output the identification information.

In the printing apparatus described above, the signal line is one of a plurality of signal lines that include a fourth signal line through which a voltage is applied and also include a fifth signal line the voltage in which is at the ground level. The logical circuit creates the identification information according to a combination between the connection of the fourth signal line and the connection of the fifth signal line.

With this structure, since the fourth signal line and fifth signal line are connected to the logical circuit as input signal lines, and identification information is created and output according to a combination between the connection of the fourth signal line and the connection of the fifth signal line, it is possible to easily create specific identification information just by changing the combination of the connections without needing another circuit. This enables identification information to be easily set in the thermal head.

In the printing apparatus described above, the control circuit creates a signal that controls the thermal head and transmits the created signal through the control signal line, according to the acquired information.

With this structure, a signal that controls the thermal head is created and transmitted through the signal line, according to the acquired information about the thermal head. Therefore, it is possible to appropriately control the thermal head depending on the thermal head.

In the printing apparatus described above, the signal line is one of a plurality of signal lines that include a sixth signal line through which a strobe signal corresponding to an energization time for the thermal head is transmitted. The control circuit controls the energization time for the thermal head through the sixth signal line according to the acquired information.

With this structure, the energization time for the thermal head is controlled through the sixth signal line according to the acquired information about the thermal head. Therefore, it is possible to execute energization matching the thermal head and suppress a drop in printing quality.

A thermal head according to a third aspect of the invention is a thermal head that is attachable to and detachable from a printing apparatus. A logical circuit having identification information about the thermal head is mountable in the thermal head. The thermal head has a signal line through which a signal that controls the thermal head is transmitted from the printing apparatus that stores information about the thermal head. The logical circuit transmits the identification information to the printing apparatus through the signal line.

With this structure, when the thermal head is attached to the printing apparatus, the printing apparatus acquires identification information from the logical circuit mounted in the thermal head by using a signal line through which a signal that controls the thermal head is transmitted, after which the printing apparatus acquires information about the thermal head from a memory according to the acquired identification information. In the acquisition of identification information, therefore, it is possible to acquire information about the attached thermal head without having to add a new special signal line.

BRIEF DESCRIPTION OF THE DRAWINGS

The invention will be described with reference to the accompanying drawings, wherein like numbers reference like elements.

FIG. 4 illustrates an example of a specification database.

DESCRIPTION OF EXEMPLARY EMBODIMENTS

Figure 1:
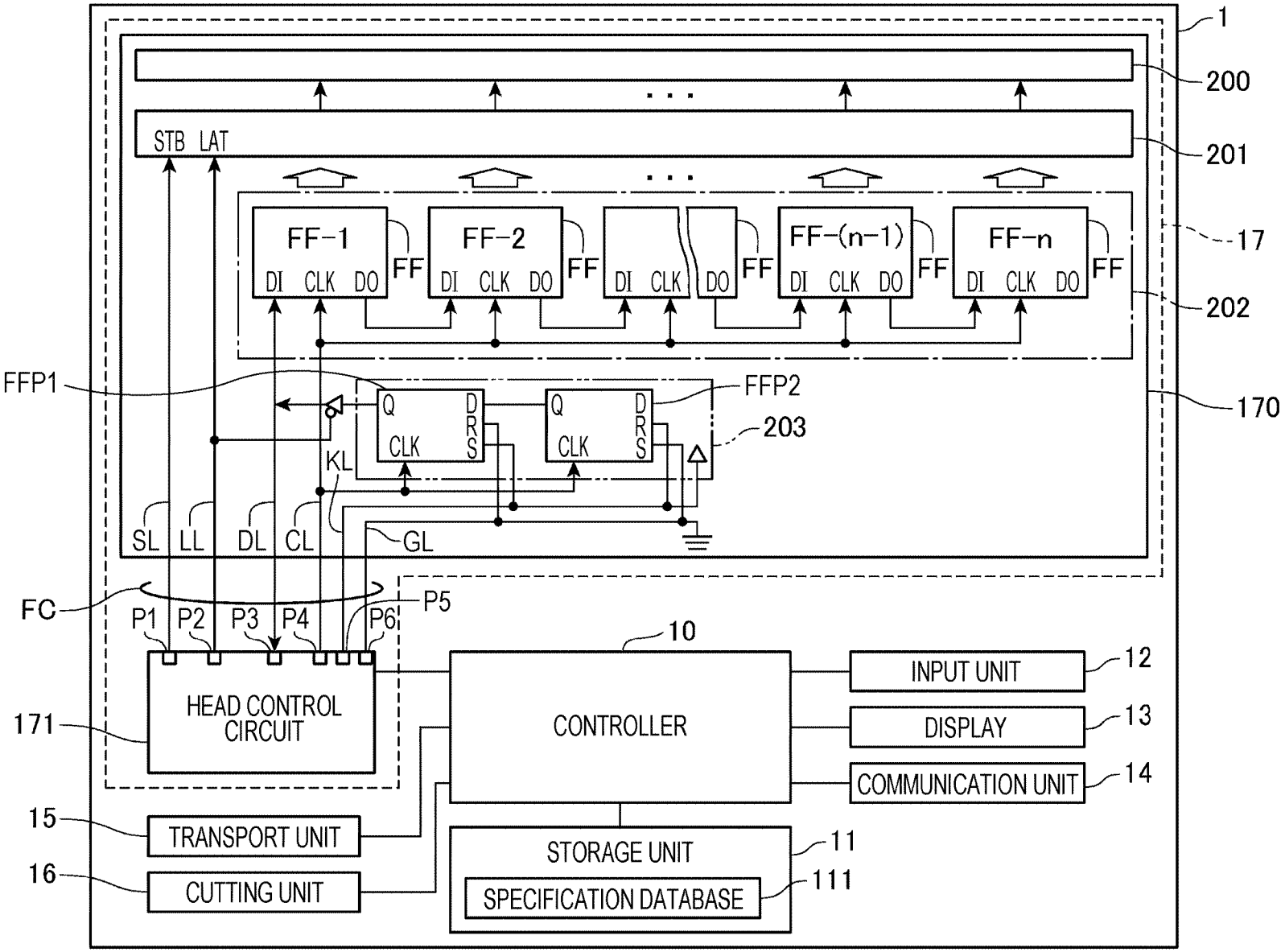
FIG. 1 illustrates the structure of a thermal printer.

FIG. 1 illustrates the structure of a thermal printer 1 (printing apparatus).

The thermal printer 1 (sometimes simply referred to below as the printer 1) accommodates heat-sensitive rolled paper in the main body as a printing medium. To print characters, an image, and the like, the printer 1 applies heat to the printing surface of the rolled paper to form pixels by using a line thermal head 170 (sometimes simply referred to below as the head 170) in which heat-generating elements are arranged in a row.

As illustrated in FIG. 1, the printer 1 has a controller 10 (control circuit), a storage unit 11, an input unit 12, a display 13, a communication unit 14, a transport unit 15, a cutting unit 16, and a printing unit 17.

The controller 10 has a central processing unit (CPU) (processor), a read-only memory (ROM), a random-access memory (RAM), an application-specific integrated circuit (ASIC), a signal processing circuit, and the like. The controller 10 controls individual sections in the printer 1. In the controller 10, the CPU, for example, reads out programs, such as firmware, stored in the ROM, the storage unit 11, or the like and executes processing. Alternatively, the controller 10 executes processing by, for example, using functions implemented in the ASIC. Alternatively, the controller 10 executes processing through, for example, collaboration between hardware and software; for example, the controller 10 executes processing by performing signal processing in the signal processing circuit.

The storage unit 11, which has a hard disk and a non-volatile memory such as an electrically erasable programmable ROM (EEPROM), stores various types of data so as to be rewritable. The storage unit 11 also stores a specification database 111, which will be described later.

The input unit 12 has an input means, such as an operation panel or touch panel, provided on the printer 1. The input unit 12 detects a manipulation performed on the input means by the user and outputs the detected manipulation to the controller 10. The controller 10 executes processing corresponding to the manipulation on the input means, in response to the input accepted from the input unit 12.

The display 13 has a plurality of light-emitting diodes (LEDs), a display panel, and the like. The display 13 turns on or off or blinks the LEDs in a predetermined aspect, displays information on the display panel, and executes other types of display, under control of the controller 10.

The communication unit 14 communicates with a host computer or another external apparatus according to a predetermined communication standard, under control of the controller 10.

The transport unit 15 has a transport roller that transports rolled paper in a transport direction, a transport motor that rotates the transport roller, a motor driver that drives the transport motor, and other components involved in transporting the rolled paper. The transport unit 15 transports the rolled paper under control of the controller 10.

The cutting unit 16 has a cutter unit including a fixed blade and a movable blade that can move so as to cross the fixed blade, a motion motor that moves the movable blade, a motor driver that drives the motion motor, and other components involved in cutting rolled paper. The cutting unit 16 cuts the rolled paper under control of the controller 10.

The printing unit 17 has a thermal head 170 and a head control circuit (input/output circuit) 171 that, for example, accepts signals from the thermal head 170 and outputs signals to the thermal head 170.

The head control circuit 171 have ports through which, for example, the head control circuit 171 accepts signals and data from the head 170, outputs signals and data to the head 170, and supplies electric power to the head 170, under control of the controller 10.

As the ports, the head control circuit 171 has at least a strobe port P1, a latch port P2, a data port P3, a clock port P4, a power supply port P5, and a ground port P6.

The strobe port P1 is connected to a strobe signal line SL (a sixth signal line). The strobe port P1 outputs a strobe signal to the head 170 through the strobe signal line SL, the strobe signal causing the head 170 to energize heat-generating elements.

The latch port P2 is connected to a latch signal line LL (second signal line). The latch port P2 outputs a latch signal to the head 170 through the latch signal line LL, the latch signal causing the head 170 to temporarily hold print data.

The data port P3 is structured so as to be switchable between an input setting and an output setting. The data port P3 is connected to a data signal line DL (first signal line) through which data is transmitted and received. The data port P3 outputs print data to the head 170 through the data signal line DL and receives identification information from an identification information holding circuit 203 (logical circuit) in the head 170 through the data signal line DL.

The clock port P4 is connected to a clock signal line CL (third signal line). The clock port P4 outputs a clock signal synchronizing with print data or identification information to the head 170 through the clock signal line CL.

The power supply port P5 is connected to a power supply signal line KL (fourth signal line). The power supply port P5 supplies electric power to the head 170 through the power supply signal line KL.

The ground port P6 is connected to a ground signal line GL (fifth signal line). The ground port P6 outputs a voltage at the ground level to the head 170 through the ground signal line GL.

Although, in FIG. 1, the power supply signal line KL and ground signal line GL are connected only to the identification information holding circuit 203, these signal lines are also connected to other circuits in the head 170 and supplies electric power to the other circuits.

The strobe signal line SL, latch signal line LL, data signal line DL, clock signal line CL, power supply signal line KL, and ground signal line GL included in the head 170 are each a signal line that is originally provided to control the driving of the head 170 and execute printing.

The strobe signal line SL, latch signal line LL, data signal line DL, clock signal line CL, power supply signal line KL, and ground signal line GL will be collectively referred to as control signal lines (or simply signal lines). Signals (strobe signal, latch signal, and clock signal), and print data (data signal) that are transmitted through some of these signal lines included in the control signal lines are equivalent to signals that control the head 170. Electric power supplied through the power supply signal line KL and a voltage output through the ground signal line GL are also equivalent to signals that control the head 170.

Although, in this embodiment, the head control circuit 171 and controller 10 are separately provided, the head control circuit 171 and controller 10 may be formed as a single unit. In this case, the single unit is equivalent to a control circuit. The CPU included in the controller 10 may have the head control circuit 171. In this case, the CPU in the controller 10 is equivalent to a control circuit.

The thermal head 170 is detachably attached to the printer 1. A flexible cable FC integrally formed from signal lines is mounted in the thermal head 170. The flexible cable FC is detachably connected to a connector on a circuit board on which the controller 10 and head control circuit 171 are mounted. The thermal head 170 is connected to the head control circuit 171 through the flexible cable FC in this way. The strobe signal line SL, latch signal line LL, data signal line DL, clock signal line CL, power supply signal line KL, and ground signal line GL included in the thermal head 170 are connected to their corresponding ports of the head control circuit 171 through the flexible cable FC.

The thermal head 170 has a heat-generating element unit 200, a latch driver 201, a shift register 202, and the identification information holding circuit 203 (logical circuit).

The heat-generating element unit 200 has a plurality of heat-generating elements arranged in a row in a direction crossing the transport direction of the rolled paper (for example, in a direction orthogonal to the transport direction), each heat-generating element being formed from a resistor.

The latch driver 201 controls heat generated from the heat-generating elements in the heat-generating element unit 200. The latch driver 201 has an input terminal STB that is connected to the strobe signal line SL and into which a strobe signal is entered, and also has an input terminal LAT that is connected to the latch signal line LL and into which a latch signal is entered. The latch driver 201 temporarily holds print data received from the shift register 202 with a latch signal entered into the input terminal LAT. In this state, the latch driver 201 energizes the heat-generating elements according to a strobe signal entered into the input terminal STB, causing the heat-generating elements to generate heat according to the print data.

The shift register 202 is formed from n flip-flops FF (n is a natural number). Of the flip-flops FF in FIG. 1, a flip-flop FF denoted by an identification symbol FF-1 is a first flip-flop FF. Similarly, a flip-flop FF denoted by an identification symbol FF-2 is a second flip-flop FF, a flip-flop FF denoted by an identification symbol FF-(n−1) is an (n−1)th flip-flop FF, and a flip-flop FF denoted by an identification symbol FF-n is an nth (last) flip-flop FF.

Each flip-flop FF in the shift register 202 has an input terminal DI into which serial data (print data) is entered, an input terminal CLK into which a clock signal synchronizing the serial data is entered, and an output terminal DO from which serial data that has overflowed from the flip-flop FF is output. In the shift register 202, the n flip-flops FF are linked in succession in such a way that the output terminal DO of the (n−1)th flip-flop FF is connected to the input terminal DI of the nth flip-flop FF.

The identification information holding circuit 203 can be mounted in the head 170. The identification information holding circuit 203 is formed from one or a plurality of flip-flops FFP. The identification information holding circuit 203 can be connected to the FC cable in the head 170 or can be mounted on a ceramic circuit board on which the latch driver 201 and shift register 202 are mounted. In this embodiment, the identification information holding circuit 203 has two flip-flops, FFP1 and FFP2. In the description below, the flip flops FFP1 and FFP2 included in the identification information holding circuit 203 will be collectively referred to as the flip-flops FFP.

Each flip-flop FFP has an output terminal Q from which data is output, an input terminal D into which data is entered, a reset terminal R, a set terminal S, and a clock terminal CLK into which a clock signal is entered through the clock signal line CL.

With each flip-flop FFP, the reset terminal R is connected to the power supply signal line KL or ground signal line GL and the set terminal S is connected to the power supply signal line KL or ground signal line GL. In this state, the flip-flop FFP holds data representing 0 or 1. In this embodiment, with the flip-flop FFP1, the reset terminal R is connected to the ground signal line GL and the set terminal S is connected to the power supply signal line KL. In this state of the flip-flop FFP1, a voltage at a low level is applied to the reset terminal R and a voltage at a high level is applied to the set terminal S, holding data representing 0. In this embodiment, with the flip-flop FFP2, the reset terminal R is connected to the power supply signal line KL and the set terminal S is connected to the ground signal line GL. In this state of the flip-flop FFP2, a voltage at a high level is applied to the reset terminal R and a voltage at a low level is applied to the set terminal S, holding data representing 1.

In this embodiment, as described above, the flip-flop FFP1 holds data representing 0 and the flip-flop FFP2 holds data representing 1. If identification information is structured so as to begin with data held in the flip-flop FFP1 followed by data held in the flip-flop FFP2, therefore, the identification information holding circuit 203 holds identification information representing 01.

In the identification information holding circuit 203, the input terminal D of the flip-flop FFP1 is connected to the output terminal Q of the flip-flop FFP2, causing the identification information holding circuit 203 to function as a shift register. The output terminal Q of the flip-flop FFP1 is connected to the data signal line DL.

Next, the operation of the printing unit 17 during printing will be described with reference to FIG. 2.

Figure 2:
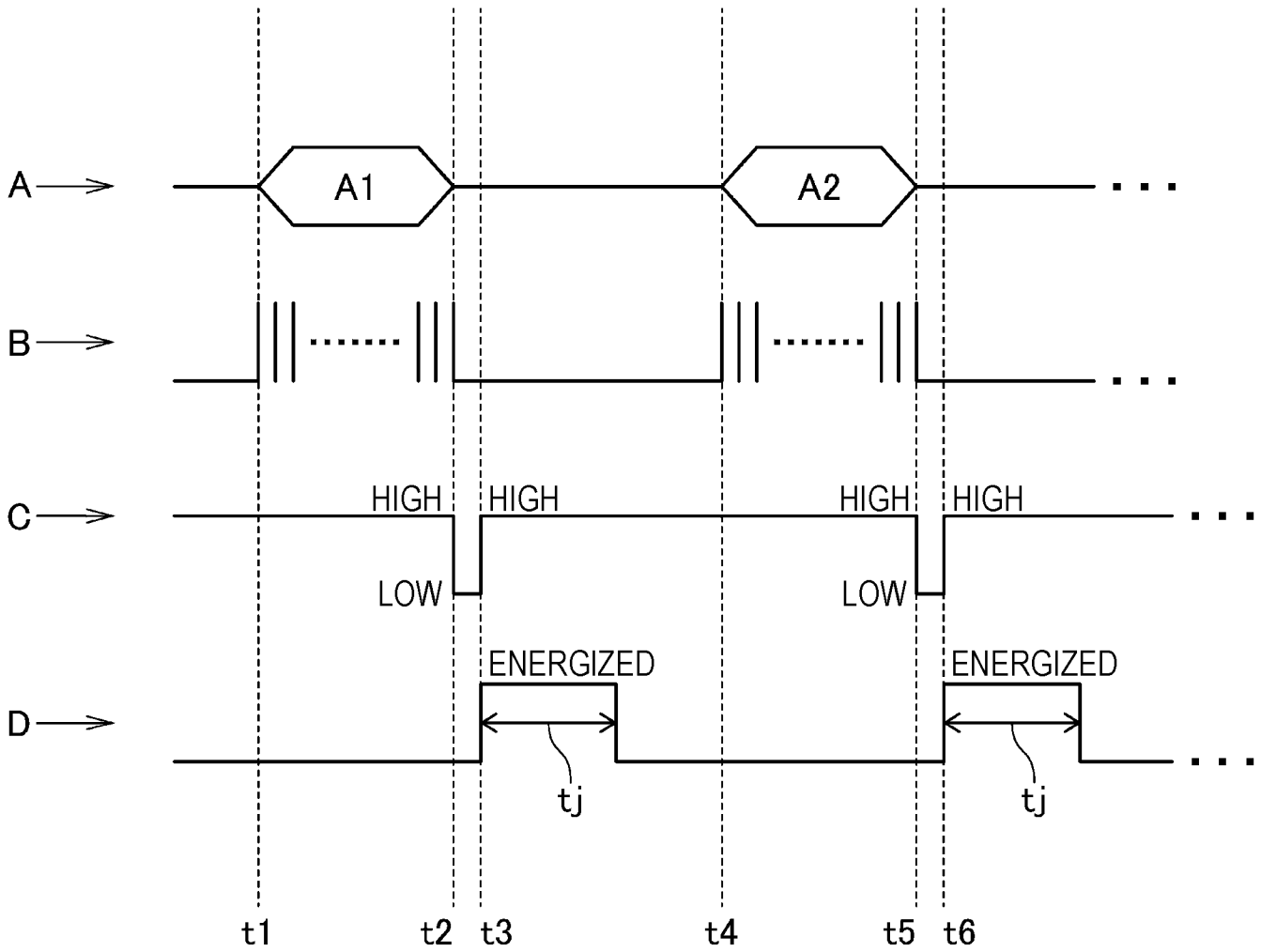
FIG. 2 is a timing diagram for signals that control a line thermal head.

FIG. 2 is a timing diagram for signals that control the thermal head 170. In FIG. 2, A indicates print data, B indicates a clock signal, C indicates a latch signal, and D indicates a strobe signal.

It will be assumed that, at the time of starting the operation described here, the head control circuit 171 has output a high-level signal to the head 170 through the latch signal line LL.

When a trigger to execute printing is generated in response to a print command from a computer connected to the printer 1 so as to be capable of communicating with the printer 1, the head control circuit 171 switches the data port P3 to the output setting under control of the controller 10.

The head control circuit 171 then starts to output clock signals and print data at time t1. Specifically, the head control circuit 171 outputs as many clock signals as there are clocks corresponding to the number of heat-generating elements to the shift register 202 through the clock signal line CL, and outputs print data A1 for one dot line to the first flip-flop FF-1 in the shift register 202 through the data signal line DL in synchronization with the clock signals. This print data is serial data. The print data output to the shift register 202 sequentially shifts from the first flip-flop FF-1 to the nth flip-flop FF-n in synchronization with the clock signals. A dot line indicates a unit of an image or data corresponding to the row of heat-generating elements included in the heat-generating element unit 200 in the head 170.

When the head control circuit 171 completes the output of the print data A1 for one dot line at time t2, the head control circuit 171 outputs a latch signal to the latch driver 201 through the latch signal line LL. Specifically, the head control circuit 171 switches the level of a voltage to be output to the latch signal line LL from high to low, and outputs the low-level voltage to the latch driver 201 as the latch signal.

The latch driver 201 receives the latch signal from the head control circuit 171, after which the latch driver 201 latches (temporarily holds) the print data A1, which has been entered into the shift register 202, for one dot line, as parallel data. Therefore, since the shift register 202 no longer needs to hold the print data, next print data is entered into the shift register 202.

After the latch driver 201 has latched the print data A1 for one dot line, the head control circuit 171 outputs a strobe signal to the latch driver 201 through the strobe signal line SL at time t3. While the strobe signal is being output, the latch driver 201 energizes heat-generating elements in the heat-generating element unit 200 that are equivalent to 1 (printing) in the print data A1 for one dot line. Specifically, the latch driver 201 energizes heat-generating elements in the heat-generating element unit 200 that are equivalent to data representing 1 for an energization time tj, which is the length of the strobe signal. Due to this energization, the relevant heat-generating elements generate heat and a portion of the rolled paper, the portion being in contact with these heat-generating elements, produce a color, executing printing according to the print data A1 for one dot line.

After printing has been executed on the rolled paper according to the print data A1 for one dot line, the controller 10 causes the transport unit 15 to transport the rolled paper for one dot line. The head control circuit 171 controls the driving of the head 170 as in the operation described above to execute printing of print data A2 for a next one dot line after the print data A1. Specifically, the head control circuit 171 starts to output clock signals and print data at time t4, and after the print data A2 for one dot line has been output, the head control circuit 171 outputs a latch signal at time t5 so that the print data A2 is latched. At time t6, the head control circuit 171 outputs a strobe signal to energize heat-generating elements. The head control circuit 171 sequentially executes printing for each one dot line in this way.

As described above, the head 170 is detachably attached to the printer 1. The thermal head 170 attached to the printer 1 may have a different specification depending on the destination (such as a country or a customer) to which the thermal head 170 is delivered. For example, the specification of the thermal head 170 includes the resistance of the heat-generating element.

It will be assumed that there is a mismatch between the specification of the thermal head 170 attached to the printer 1 and the specification of the thermal head 170 to be controlled by the printer 1. In this case, the printer 1 cannot appropriately control a time during which the heat-generating elements are energized, resulting in a deep-colored or light-colored printout. This may not lead to print quality desired by the user.

Therefore, it is desirable for the printer 1 to acquire specification information (information about the thermal head 170) that indicates the specification of the thermal head 170 attached to the printer 1 and to control the energization time tj that matches the specification of the attached thermal head 170. If, however, a new signal line is added to the thermal head 170 to acquire specification information about the head 170, a new port needs to be provided in the head control circuit 171 or the specification of the flexible cable FC that interconnects the thermal head 170 and head control circuit 171 needs to be changed (because the number of wires is increased). This leads to an increase in costs. Another problem is that compatibility between printers 1 is lost.

In view of this, the thermal head 170 in this embodiment has the identification information holding circuit 203 and the printer 1 in this embodiment executes the operation described below.

Figure 3:
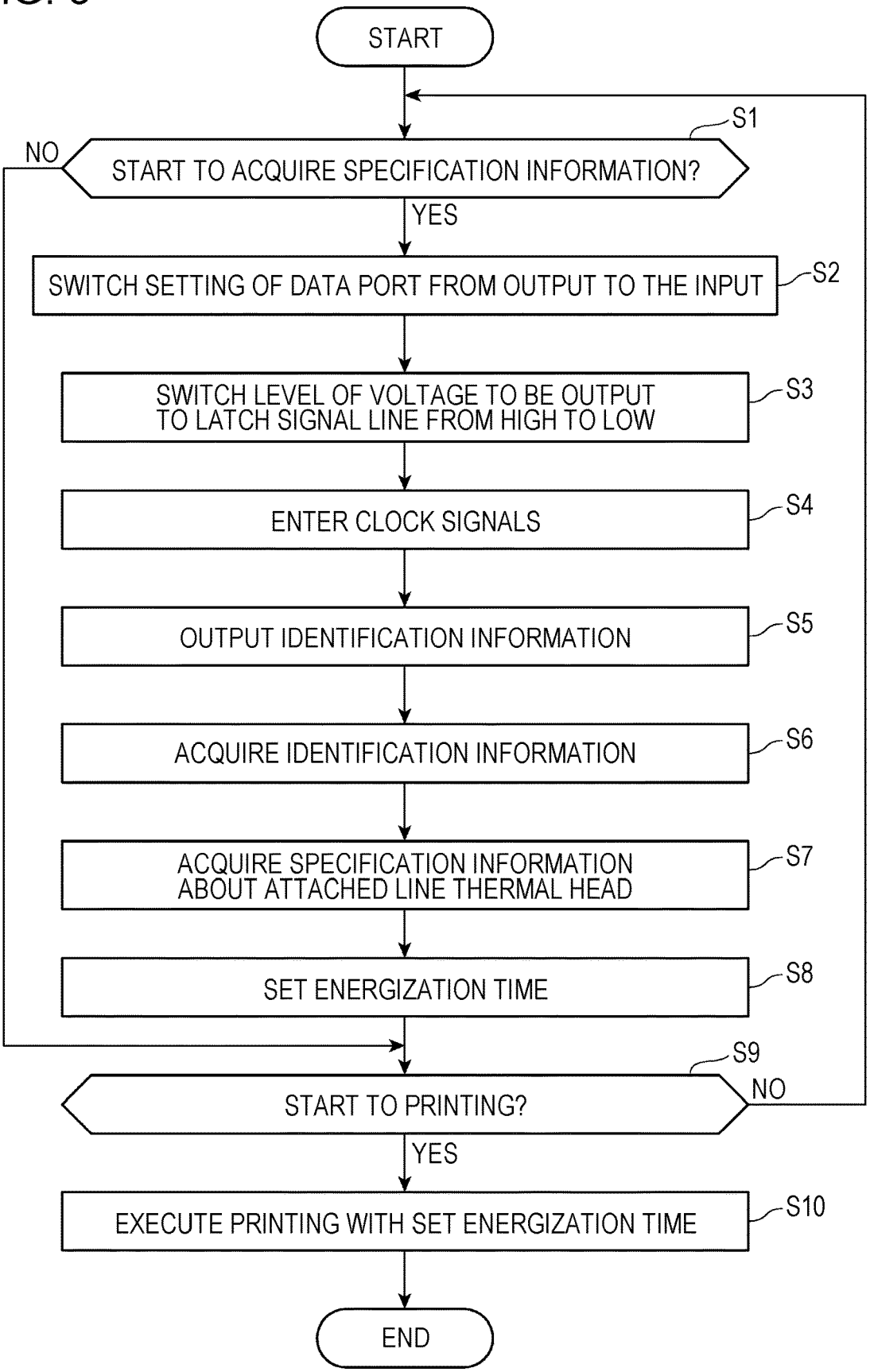
FIG. 3 is a flowchart illustrating the operation of the thermal printer.

FIG. 3 is a flowchart illustrating the operation of the thermal printer 1.

It will be assumed that, at the time of starting the flowchart in FIG. 3, the head control circuit 171 has output a high-level voltage to the latch driver 201 through the latch signal line LL.

It will be also assumed that, at the time of starting the flowchart in FIG. 3, the data port P3 is at the output setting.

First, the controller 10 in the printer 1 decides whether to start to acquire specification information about the attached thermal head 170 (step S1). If, for example, the printer 1 is powered on for the first time after the printer 1 has been shipped from a factory or the like, the controller 10 decides to start to acquire specification information about the thermal head 170. If, for example, the head 170 has been substituted, the controller 10 also decides to start to acquire specification information about the head 170. If, for example, the input unit 12 detects a manipulation that commands the acquisition of specification information about the head 170, the controller 10 also decides to start to acquire specification information about the head 170 in response to the input from the input unit 12. The controller 10 also decides to start to acquire specification information about the head 170 in response to a command from, for example, a computer.

If the controller 10 decides not to start to acquire specification information about the head 170 (the result in step S1 is No), the controller 10 causes processing to proceed to step S9. If the controller 10 decides to start to acquire specification information about the head 170 (the result in step S1 is Yes), the controller 10 controls the head control circuit 171 so that it switches the setting of the data port P3 from output to the input (step S2).

After the head control circuit 171 has switched the data port P3 to the input setting, the head control circuit 171 switches the level of the voltage to be output to the latch signal line LL from high to low (step S3), under control of the controller 10. As illustrated in FIG. 2, when the latch signal is low, none of print data, clock signals or a strobe signal is output. Therefore, when the latch signal is low, it is possible to acquire identification information from the identification information holding circuit 203 by using the signal lines corresponding to these signals without interference with the signals.

After the head control circuit 171 has switched the level of the voltage to be output to the latch signal line LL from high to low, the head control circuit 171 enters as many clock signals as there are clocks corresponding to the number of flip-flops FFP included in the identification information holding circuit 203 to the identification information holding circuit 203 through the clock signal line CL (step S4). In this embodiment, the head control circuit 171 outputs clock signals for two clocks.

Upon the reception of the clock signals for two clocks, the identification information holding circuit 203 outputs data held in the flip-flop FFP1 (in this example, the data is 0) to the data signal line DL in response to a clock signal for a first clock. The identification information holding circuit 203 also shifts data held in the flip-flop FFP2 (in this example, the data is 1) to the flip-flop FFP1. The identification information holding circuit 203 further outputs the data that has been shifted to the flip-flop FFP1 (in this example, the data is 1) to the data signal line DL in response to a clock signal for a second clock. The identification information holding circuit 203 outputs identification information (in this example, 01) in this way (step S5).

After the identification information holding circuit 203 has output the identification information, the head control circuit 171 acquires the identification information, which is 01, through the data signal line DL because the data port P3 is at the input setting (step S6). After acquiring the identification information, the head control circuit 171 outputs the acquired identification information to the controller 10.

Next, the controller 10 acquires specification information about the attached head 170 according to the identification information received from the head control circuit 171 and the specification database 111 stored in the storage unit 11 (step S7).

FIG. 4 illustrates an example of the specification database 111.

As illustrated in FIG. 4, an identification information field F1, an entity field F2, and a resistance field F3 are mutually associated in one record in the specification database 111.

The identification information field F1 stores identification information about the head 170. In the example in FIG. 4, the identification information field F1 stores identification information indicating 00, identification information indicating 01, identification information indicating 10, and identification information indicating 11.

The entity field F2 stores entity information indicating the entity that manufactures the head 170. In the example in FIG. 4, the entity field F2 stores entity information indicating company A and entity information indicating company B.

The resistance field F3 stores resistance information indicating the resistance of the heat-generating elements included in the heat-generating element unit 200 in the head 170. In the example in FIG. 4, the resistance field F3 stores resistance information indicating 500 ohms and resistance information indicating 800 ohms. Resistance information is equivalent to specification information about the head 170, as will be described below.

A record R1 stores identification information indicating 00 in the identification information field F1, stores entity information indicating company A in the entity field F2, and stores resistance information indicating 500 ohms in the resistance field F3. This indicates that, for the head 170 for which identification information is 00, the entity is company A and the resistance of the heat-generating elements is 500 ohms.

A record R2 stores identification information indicating 01 in the identification information field F1, stores entity information indicating company A in the entity field F2, and stores resistance information indicating 800 ohms in the resistance field F3. This indicates that, for the head 170 for which identification information is 01, the entity is company A and the resistance of the heat-generating elements is 800 ohms.

A record R3 stores identification information indicating 10 in the identification information field F1, stores entity information indicating company B in the entity field F2, and stores resistance information indicating 500 ohms in the resistance field F3. This indicates that, for the head 170 for which identification information is 10, the entity is company B and the resistance of the heat-generating elements is 500 ohms.

A record R4 stores identification information indicating 11 in the identification information field F1, stores entity information indicating company B in the entity field F2, and stores resistance information indicating 800 ohms in the resistance field F3. This indicates that, for the head 170 for which identification information is 11, the entity is company B and the resistance of the heat-generating elements is 800 ohms.

Referring again to the flowchart in FIG. 3, in step S7, the controller 10 identifies a record that stores the identification information acquired in step S6 from the specification database 111 and acquires resistance information stored in the F3 in the identified record as specification information. Resistance information is stored in the specification database 111 as specification information, so when the storage unit 11 stores the specification database 111, this is equivalent to saying that the storage unit 11 stores specification information.

If the identification information acquired in step S6 is 01, the controller 10 identifies the record R2 from the records R1 to R4 stored in the specification database 111. After having identified the record R2, the controller 10 acquires resistance information indicating 800 ohms stored in the resistance field F3 in the record R2 as specification information.

As described above, the head control circuit 171 acquires identification information about the head 170 from the identification information holding circuit 203 by using a control signal line, and the controller 10 acquires, from the storage unit 11, resistance information corresponding to the identification information acquired by the head control circuit 171 as specification information about the head 170. Thus, the printer 1 can acquire specification information about the head 170 without having to add a new special signal line used to acquire the identification information from the identification information holding circuit 203.

The head control circuit 171 switches the data port P3 to the input setting and acquires identification information about the head 170 from the identification information holding circuit 203 by using the data signal line DL. Thus, the head control circuit 171 can acquire identification information about the head 170 by using the data signal line DL, which is originally provided to transmit print data, so the head control circuit 171 can acquire identification information about the head 170 without having to have a special port used to acquire the identification information. Since there is no need to add a new special port, the flexible cable FC that is originally provided can be used. This can suppress an increase in the cost of the printer 1.

In addition, if the latch signal is not at the high-level voltage, that is, at the low-level voltage, the identification information holding circuit 203 outputs identification information to the head control circuit 171. As described above, when the latch signal is at the high-level voltage, the head control circuit 171 transmits print data for one dot line to the head 170 through the data signal line DL. Therefore, the latch signal at the high-level voltage indicates an active state in the control of the head 170. That is, the latch signal not at the high-level voltage indicates a non-active state in the control of the head 170. When the latch signal is at the low-level voltage, the identification information holding circuit 203 outputs identification information to the head control circuit 171. Therefore, when using a control signal line that is originally provided, the head control circuit 171 can acquire identification information by using a state in which the head 170 is not executing printing. This enables the head control circuit 171 to efficiently acquire identification information.

Furthermore, the identification information holding circuit 203 outputs identification information in synchronization with clock signals for two clocks received from the head control circuit 171. That is, the identification information holding circuit 203 outputs identification information by using a clock signal received from the head control circuit 171 as a trigger. Thus, the head control circuit 171 can acquire identification information abut the head 170 from the identification information holding circuit 203 by using the clock signal line CL, which is originally provided, without having to add a new signal line used to output the identification information from the identification information holding circuit 203.

Referring again to the flowchart in FIG. 3, after having acquired resistance information as specification information about the attached head 170, the controller 10 in the printer 1 sets the energization time tj during which the heat-generating elements are energized, according to the acquired resistance information (step S8).

It will be assumed that, for example, the storage unit 11 in the printer 1 stores a setting file that stores combinations between setting items related to the printer 1 and settings corresponding to these setting items. In this case, the controller 10 acquires the energization time tj during which the heat-generating elements are energized, according to the acquired resistance information, after which the controller 10 sets a setting corresponding to the acquired energization time tj in a setting item related to energization time. "Set" described here is equivalent to setting the energization time tj in step S8. When acquiring the energization time tj according to the acquired resistance information, the controller 10 may calculate the energization time tj from the resistance according to a predetermined algorithm. Alternatively, the controller 10 may acquire the energization time tj with reference to a predetermined table in which resistance information and information indicating the energization time tj are mutually associated. If it is found from the identity information about the head manufacturing identities, the identity information being stored in the entity field F2 that, for example, company A uses a thick film in the structure of the heat-generating element and company B uses a thin film, a setting file or table may be provided in which different energization times tj corresponding to these films are reflected.

If the resistance indicated by the resistance information acquired this time is smaller than the resistance indicated by the resistance information acquired last time, the controller 10 sets, in step S8, the energization time tj shorter than the already-set energization time tj. By contrast, if the resistance indicated by the resistance information acquired this time is larger than the resistance indicated by the resistance information acquired last time, the controller 10 sets, in step S8, the energization time tj longer than the already-set energization time tj.

After having set the energization time tj according to the acquired resistance information, the controller 10 decides whether to start printing by the printing unit 17 (step S9). If, for example, the communication unit 14 receives print data from the outside, the controller 10 decides to start printing by the printing unit 17. Alternatively, if the input unit 12 detects a manipulation that commands the execution of printing, the controller 10 decides to start printing by the printing unit 17 in response to an input from the input unit 12.

If the controller 10 decides not to start printing by the printing unit 17 (the result in step S9 is No), the controller 10 returns processing to step S1. If the controller 10 decides to start printing by the printing unit 17 (the result in step S9 is Yes), under control of the controller 10, the head control circuit 171 outputs a strobe signal indicating the energization time tj set in step S7 to the head 170 through the strobe signal line SL and executes printing one dot line at a time as described above (step S10).

As described above, when executing printing, the head control circuit 171 outputs, to the head 170, a strobe signal indicating the energization time tj based on resistance information used as specification information about the head 170. Thus, the head control circuit 171 can energize the heat-generating elements in the head 170 for the energization time tj that is suitable to the resistance of the heat-generating elements. Therefore, the printer 1 can suppress an event in which a deep-colored or light-colored printout is produced depending on the specification of the attached head 170. This makes it possible to increase the probability that printing can be performed with printing quality desired by the user and to maintain uniform printing quality.

Although, in the above embodiment, the structure in which the identification information holding circuit 203 has the flip-flops FFP1 and FFP2 has been exemplified, the number of flip-flops FFP included in the identification information holding circuit 203 is not limited to 2; any number of flip-flops FFP can be included. However, a plurality of flip-flops FFP is preferably included in the identification information holding circuit 203. This is because the more flip-flops FFP are included in the identification information holding circuit 203, the more records can be stored in the specification database 111, making it possible to widely adapt to the specification of the attached thermal head 170.

As illustrated in FIG. 1, the identification information holding circuit 203 holds identification information based on data held in the flip-flops FFP1 and FFP2. In this embodiment, the flip-flop FFP1 holds data indicating 0 and flip-flop FFP2 holds data indicating 1, so the identification information holding circuit 203 holds identification information indicating 01. The flip-flops FFP1 and FFP2 each hold data corresponding to a combination of the connection of the power supply signal line KL and the connection of the ground signal line GL. As described above, in the flip-flop FFP1, the reset terminal R is connected to the ground signal line GL and the set terminal S is connected to the power supply signal line KL, holding data indicating 0; in the flip-flop FFP2, the reset terminal R is connected to the power supply signal line KL and the set terminal S is connected to the ground signal line GL, holding data indicating 1. The identification information holding circuit 203 creates identification information corresponding to a combination of the connection of the power supply signal line KL and the connection of the ground signal line GL to each flip-flop FFP in this way. Therefore, the identification information holding circuit 203 can easily create various types of identification information just by changing the combination of the connection of the power supply signal line KL and the connection of the ground signal line GL to at least one flip-flop FFP. This enables identification information about the head 170 to be easily set without having to add a new special signal line used to create the identification information about the head 170.

As described above, the thermal printer 1 has the identification information holding circuit 203 that has identification information, the thermal head 170 in which the identification information holding circuit 203 is mounted, a control signal line through which a signal that controls the thermal head 170 is transmitted, the storage unit 11 that store specification information about the thermal head 170 corresponding to the identification information, and the controller 10 that acquires the identification information that has been output from the identification information holding circuit 203 through the control signal line and also acquires specification information from the storage unit 11 according to the acquired identification information.

The thermal printer 1 has the thermal head 170 in which the identification information holding circuit 203 that has identification information is mounted, a plurality of signal lines through which signals that controls the driving of the thermal head 170 are conveyed, the storage unit 11 that stores specification information about the thermal head 170 in relation to the identification information, and the controller 10 that acquires the identification information through one of the plurality of signal lines, the identification information having been output from the identification information holding circuit 203, and also acquires specification information related to the acquired identification information from the storage unit 11. Of the plurality of signal lines, the signal line through which the identification information is conveyed is a signal line through which print data is conveyed to the thermal head 170.

With this structure, the head control circuit 171 (controller 10) can acquire identification information from the identification information holding circuit 203 mounted in the thermal head 170 by using a control signal line through which a signal that controls the driving of the thermal head 170 is output. Therefore, in the acquisition of identification information, there is no need to add a new special signal line. The controller 10 can acquire specification information about the thermal head 170 corresponding to the identification information.

The control signal line is one of a plurality of control signal lines that include the data signal line DL (first signal line) through which print data is transmitted to the head 170. The head control circuit 171 is connected to the data signal line DL. The head control circuit 171 has the data port P3 (port) that is switchable between an input setting and an output setting. The head control circuit 171 switches the data port P3 to the input setting to acquire identification information that has been output from the identification information holding circuit 203 to the data signal line DL.

With this structure, identification information about the head 170 can be acquired by switching the data port P3 to the input setting. Therefore, identification information about the head 170 can be acquired without having to add a new special port, a signal line, or the like to the head control circuit 171.

The control signal line is one of a plurality of control signal lines that include the latch signal line LL (second signal line) through which a latch signal is transmitted to the head 170, the latch signal causing print data to be temporarily held. When the latch signal is not in an active state in the control of the thermal head 170, that is, when the voltage to be output to the latch signal line LL is at the low level, the identification information holding circuit 203 outputs identification information about the thermal head 170 to the head control circuit 171.

With this structure, when using a control signal line that is originally provided, the head control circuit 171 can acquire identification information by using a state in which the thermal head 170 is not executing printing. Therefore, the head control circuit 171 can acquire identification information without interference with the control of the thermal head 170.

The control signal line is one of a plurality of control signal lines that include the clock signal line CL (third signal line) through which a clock signal that synchronously transmits print data to the thermal head 170 is transmitted. The identification information holding circuit 203 outputs identification information about the thermal head 170 in synchronization with the clock signal entered through the clock signal line CL.

With this structure, since the identification information holding circuit 203 outputs identification information in synchronization with a clock signal entered through the clock signal line CL, it is possible to acquire identification information about the head 170 without having to add a new special signal line used to output the identification information.

The control signal line is one of a plurality of control signal lines that include the power supply signal line KL (fourth signal line) through which a voltage is applied and also include the ground signal line GL (fifth signal line) the voltage in which is at the ground level. The identification information holding circuit 203 creates identification information according to a combination between the power supply signal line KL and ground signal line GL connected to each flip-flop FFP.

With this structure, the identification information holding circuit 203 creates identification information according to a combination of the connection of the power supply signal line KL and the connection of the ground signal line GL to each flip-flop FFP. Therefore, the identification information holding circuit 203 can easily create various types of identification information just by changing the combination of the connection of the power supply signal line KL and the connection of the ground signal line GL to at least one flip-flop FFP. Therefore, it is possible to easily set identification information about the thermal head 170 without having to add a new special signal line used to create the identification information about the thermal head 170.

The head control circuit 171 (controller 10) transmits a signal that controls the thermal head 170 through a control signal line, according to the acquired specification information. In particular, in this embodiment, the control signal line is one of a plurality of control signal lines that include the strobe signal line SL (sixth signal line) through which a strobe signal corresponding to the energization time tj for the thermal head 170 is transmitted. The controller 10 sets the energization time tj according to the acquired specification information. The head control circuit 171 transmits a strobe signal corresponding to the set energization time tj to the thermal head 170 through the strobe signal line SL.

With this structure, since the head control circuit 171 transmits, according to the specification information about the thermal head 170, a signal that controls the thermal head 170 through a control signal line, the head control circuit 171 can appropriately control the thermal head 170 according to the specification of the thermal head 170. In particular, in this embodiment, since the head control circuit 171 transmits a strobe signal corresponding to the energization time tj that matches the specification of the thermal head 170, it is possible to energize the heat-generating elements for the energization time tj that matches the specification of the thermal head 170 and thereby suppress a drop in printing quality.

The embodiment described above just indicates one aspect of the invention. The embodiment can be arbitrarily modified and applied without departing from the intended scope of the invention.

In the above embodiment, for example, resistance information about the heat-generating elements included in the heat-generating element unit 200 in the thermal head 170 has been exemplified as specification information about the thermal head 170. However, specification information is not limited to resistance information. Information indicating the property of the heat-generating elements, information indicating a serial number, or other information may be used. Even in this case, the printer 1 can still appropriately control the thermal head 170 according to its specification, by using information other than resistance information.

In the above embodiment, for example, a case in which the specification database 111 stores resistance information as specification information has been exemplified. However, the specification database 111 may further store other various types of specification information. For example, the specification database 111 may store information indicating the number of heat-generating elements included in the thermal head 170, information indicating the property of these heat-generating elements, and other information. If these information items are stored in the specification database 111 in correspondence to identification information about the thermal head 170, when the printer 1 acquires the identification information about the thermal head 170, the printer 1 can control the thermal head 170 according to various types of specification information.

In FIG. 1, the structure of the printer 1 is schematically illustrated so that the invention can be easily understood; the structure is divided into functional elements according to their main processing. The structure of the printer 1 can also be divided into more constituent elements. The structure of the printer 1 can also be divided so that a single constituent element can execute more processing. Processing by each constituent element may be executed by a single piece of hardware or a plurality of pieces of hardware. Processing by each constituent element may be implemented by a single program or a plurality of programs.

Processing in the flowchart in FIG. 3 is divided into processing units according to main processing so that processing of the printer 1 can be easily understood. The invention is not limited by the method of dividing the processing into processing units or their names. Processing by the printer 1 can also be divided into more processing units according to the processing. Processing by the printer 1 can also be divided so that a single processing unit includes more processing. The processing sequence of the flowchart described above is not limited to the sequence in the example illustrated in the drawing if similar processing is performed.

What is claimed is:

1. A printing apparatus comprising:

a logical circuit that has identification information;

a thermal head in which the logical circuit is mounted;

signal lines through which signals that control the thermal head are transmitted, the signal lines including a first signal line through which print data is transmitted to the thermal head;

a memory that stores information about the thermal head corresponding to the identification information; and a control circuit connected to the first signal line and configured to:

have a port that is switchable between an input setting and an output setting, switch the port to the input setting to acquire the identification information output from the logical circuit to the first signal line, acquire, thought the first signal line, the identification information output from the logical circuit, and acquire the information about the thermal head from the memory according to the acquired identification information.

2. The printing apparatus according to claim 1, wherein:

the signal lines include a second signal line through which a latch signal is transmitted to the thermal head, the latch signal causing print data to be temporarily held; and when the latch signal is not in an active state in control of the thermal head, the logical circuit outputs the identification information to the control circuit.

3. The printing apparatus according to claim 1, wherein:

the signal lines include a third signal line through which a clock signal that synchronously transmits print data to the thermal head is transmitted; and the logical circuit outputs the identification information in synchronization with the clock signal entered through the third signal line.

4. The printing apparatus according to claim 1, wherein:

the signal lines include a fourth signal line through which a voltage is applied and a fifth signal line a voltage in which is at a ground level; and the logical circuit creates the identification information according to a combination between a connection of the fourth signal line and a connection of the fifth signal line.

5. The printing apparatus according to claim 1, wherein the control circuit creates the signals that control the thermal head and transmits the created signal through the signal lines, according to the acquired information.

6. The printing apparatus according to claim 5, wherein:

the signal lines include a sixth signal line through which a strobe signal corresponding to an energization time for the thermal head is transmitted; and the control circuit controls the energization time for the thermal head through the sixth signal line according to the acquired information.

7. A thermal head attachable to and detachable from a printing apparatus having a port that is switchable between an input setting and an output setting and storing information about the thermal head, the thermal head comprising:

a heat-generating element unit having heat-generating elements;

signal lines through which signals that control the thermal head are transmitted, the signal lines including a first signal line through which print data is transmitted from the printing apparatus; and a logical circuit having identification information about the thermal head, wherein the logical circuit is configured to transmit, through the first signal line, the identification information to the printing apparatus when the port switches to the input setting, and the thermal head is configured to acquire the signals according to the identification information about the thermal head from the printing apparatus.

8. A printing apparatus comprising:

a logical circuit that has identification information;

a thermal head in which the logical circuit is mounted;

signal lines through which signals that control the thermal head are transmitted, the signal lines including a signal line through which a latch signal is transmitted to the thermal head, the latch signal causing print data to be temporarily held;

a memory that stores information about the thermal head corresponding to the identification information; and a control circuit connected to the signal line and configured to acquire the identification information output from the logical circuit and acquire the information about the thermal head from the memory according to the acquired identification information, wherein when the latch signal is not in an active state in control of the thermal head, the logical circuit outputs the identification information to the control circuit.

* * * * *